United States Patent [19]

Greiner

[11] 4,126,016

[45] Nov. 21, 1978

[54] VACUUM INTERCONNECT FOR HEATING AND COOLING UNIT

[76] Inventor: Leonard Greiner, 2853-A Hickory Pl., Costa Mesa, Calif. 92626

[21] Appl. No.: 819,330

[22] Filed: Jul. 27, 1977

[51] Int. Cl.[2] ..... F25D 3/08; F25D 3/10; F25B 17/08; F25B 13/00

[52] U.S. Cl. ..... 62/457; 62/294; 62/480; 165/2; 165/105

[58] Field of Search ..... 62/119, 514 R, 293, 62/294, 457, 476, 477, 480, 394; 165/2, 105

[56] References Cited

U.S. PATENT DOCUMENTS

| | | | |
|---|---|---|---|
| 2,144,441 | 1/1939 | Schlumbohm | 62/480 |
| 3,414,050 | 12/1968 | Anand | 165/105 |
| 3,642,059 | 2/1972 | Greiner | 165/2 |
| 3,970,068 | 7/1976 | Sato | 62/294 |
| 4,054,037 | 10/1977 | Yoder | 62/457 |

*Primary Examiner*—Lloyd L. King
*Attorney, Agent, or Firm*—Knobbe, Martens, Olson, Hubbard & Bear

[57] ABSTRACT

The heating and cooling apparatus comprises two vessels connected by a conduit, the first containing a vaporizable liquid, for example, water, and the second containing a vapor-absorptive chemical such as magnesium chloride. Liquid evaporates from the first vessel, and the vapor from this evaporation passing through the conduit is absorbed in the vapor-absorptive chemical. This process is exothermic at the vapor-absorptive container and endothermic at the vaporizing container, and is thus useful for cooling or heating other materials. The conduit connecting these vessels must be evacuated so that other gases do not interfere with the vapor process. By this means the pressure within the conduit can be determined solely by the vapor pressure of the evaporating liquid. The present invention permits the operation of a very simple valve which assures maintenance of the vacuum in the conduit before and during operation of the refrigeration cycle. One embodiment of the present invention comprises a valve and interconnect which allows the conduit to be formed as two pieces, one connected to each of the vessels. This interconnect and valve seals each of the conduit segments prior to interconnection and permits interconnection of the evacuated conduit sections without introducing any air to the conduit. Another embodiment of the present invention provides an extremely simple and inexpensive valve for fluidly interconnecting the pair of vessels while maintaining the vacuum integrity, but in this embodiment the vessels are manufactured and evacuated while mechanically joined by the conduit and remain mechanically connected prior to and during use.

15 Claims, 11 Drawing Figures

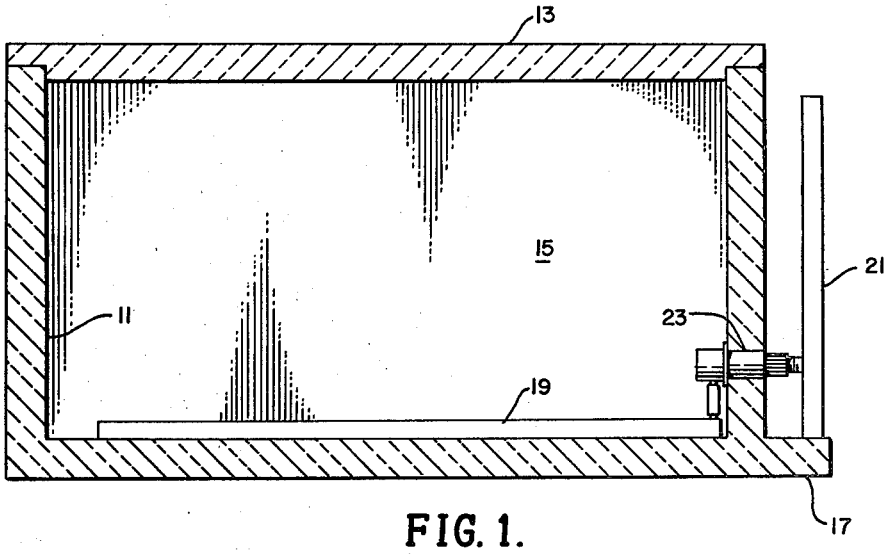
FIG. 1.
FIG. 2.
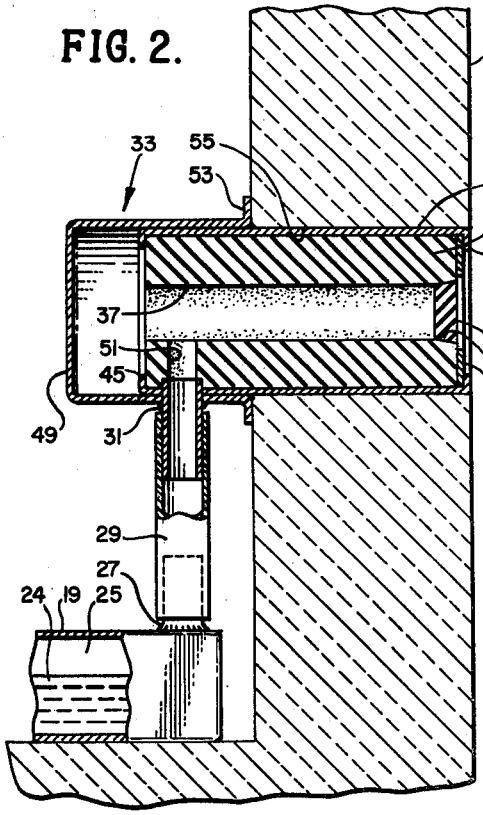
FIG. 3.
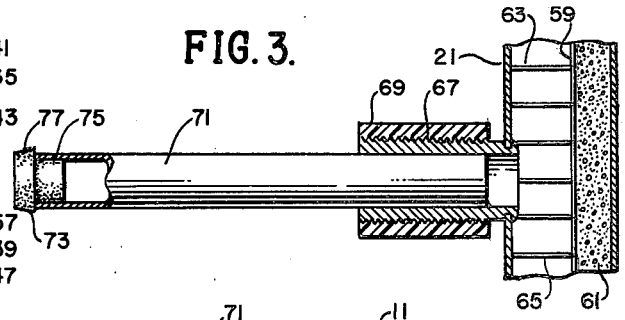
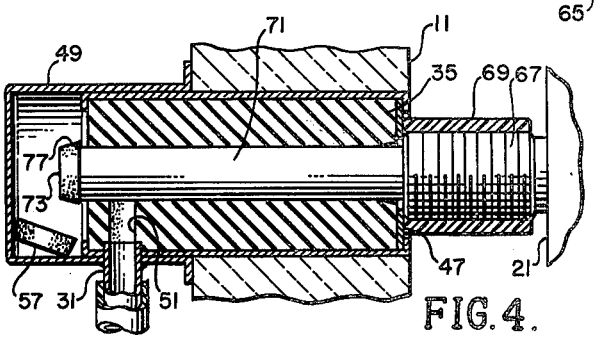
FIG. 4.
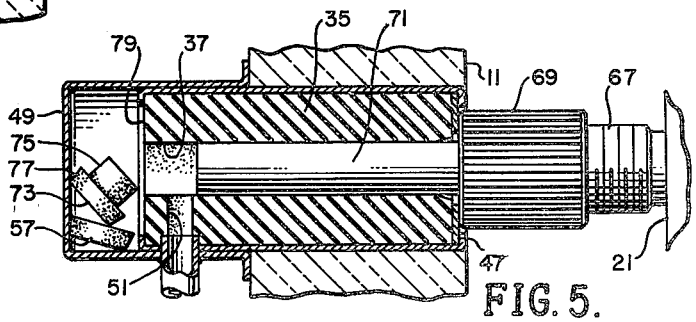
FIG. 5.

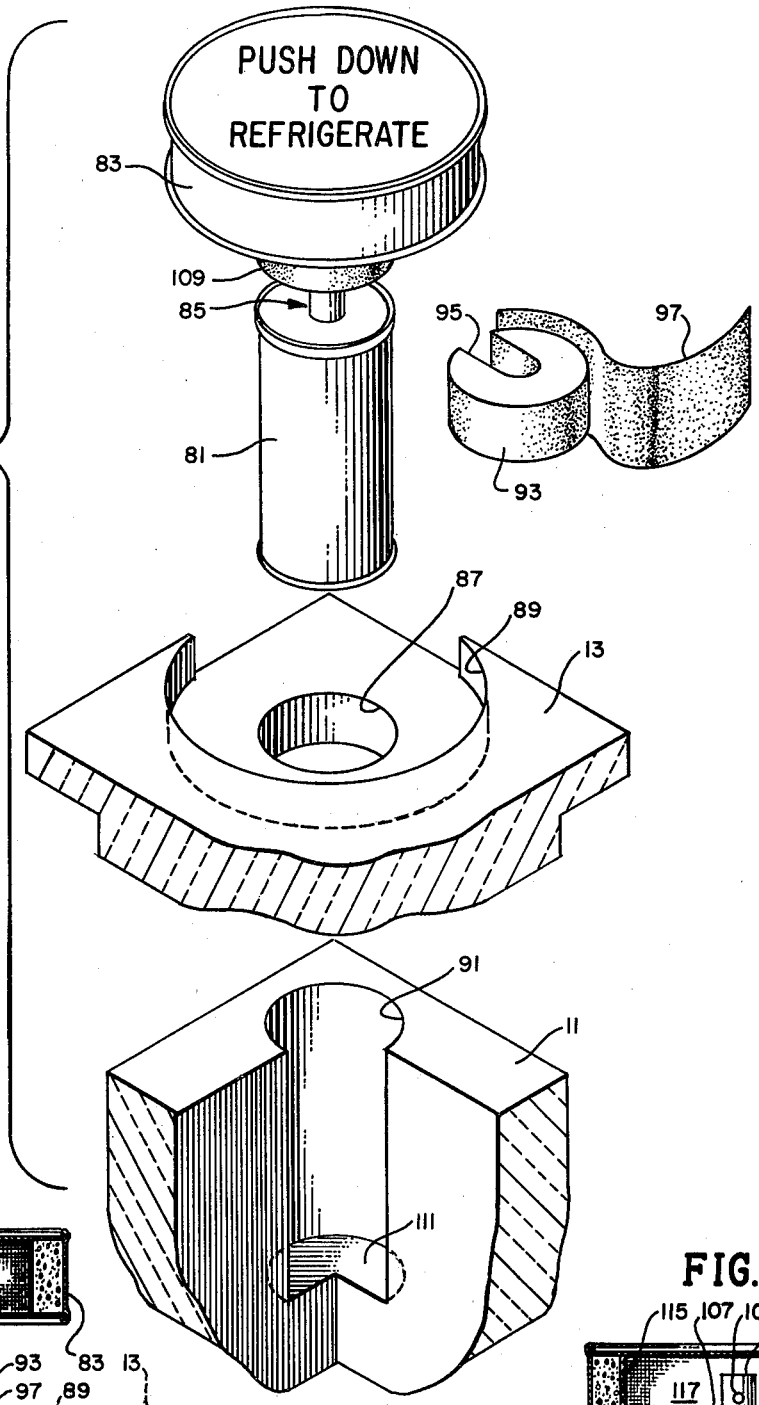
FIG. 6.
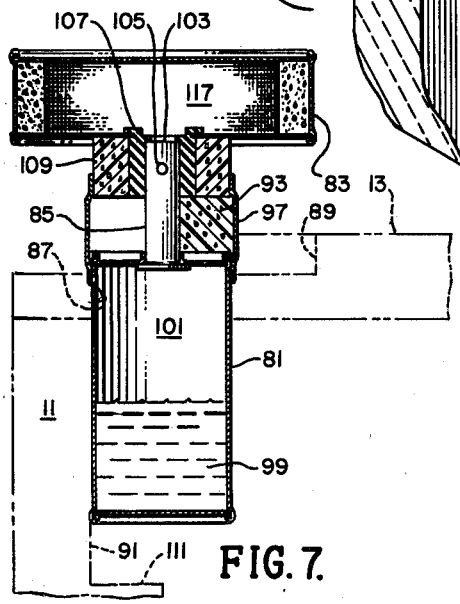
FIG. 7.
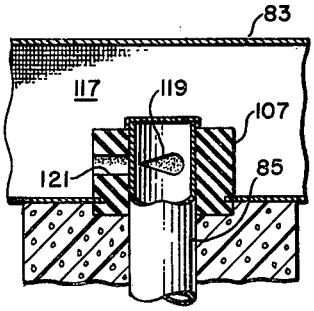
FIG. 9.
FIG. 8.
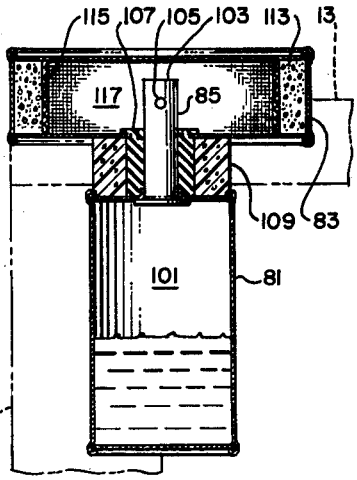

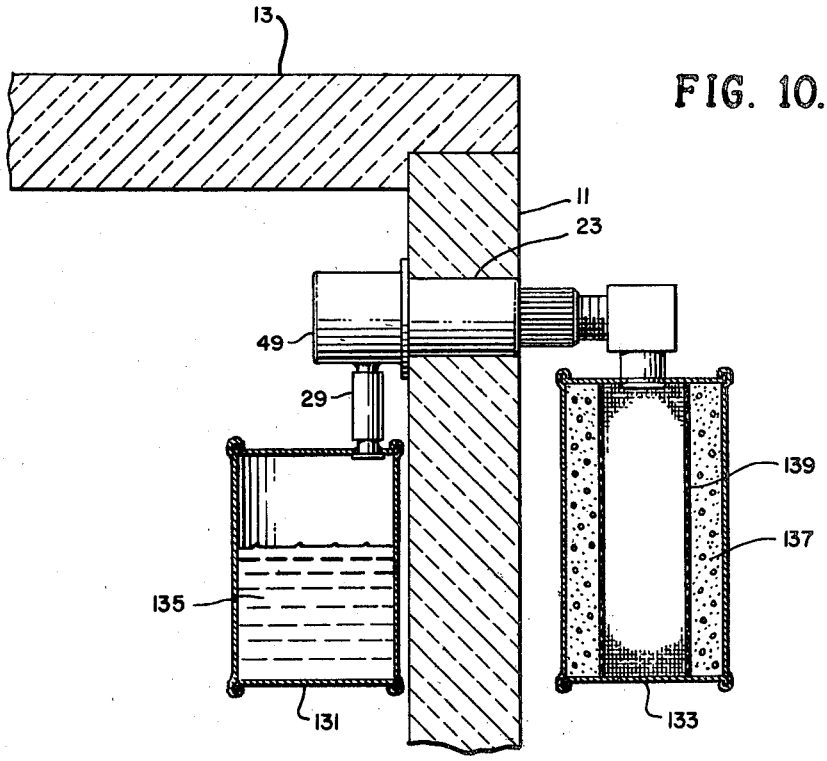
FIG. 10.
FIG. 11.
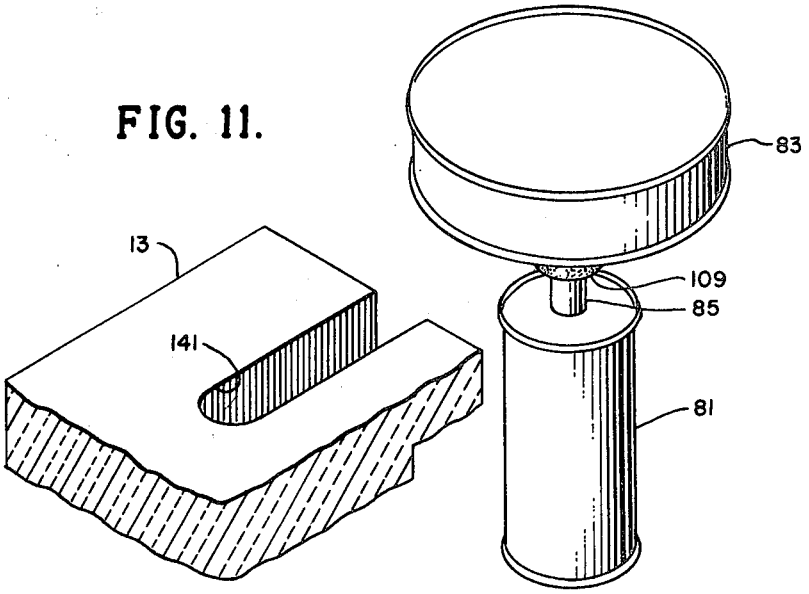

VACUUM INTERCONNECT FOR HEATING AND COOLING UNIT

BACKGROUND OF THE INVENTION

Apparatus for interconnecting a vaporizable liquid and a vapor-absorptive chemical through a separable conduit is disclosed in my prior U.S. Pat. No. 3,642,059, issued Feb. 15, 1972. In that patent the separable connection was described as a bayonet-type connection or puncture sealing type which permitted disconnection of two conduit sections. Such interconnections, however, do not adequately provide two necessary and usually incompatible requirements which permit the maintenance of a vacuum within the conduit. These requirements are that (a) the connector must exclude all air from each of the conduit sections prior to interconnection and (b) during and after interconnection no air may be admitted to the conduit. At the same time, the interconnection must provide through-flow between the conduit sections. The prior art has provided external control of valves in absorptive refrigeration systems only through complicated and expensive sealing arrangements. In addition, prior art valved interconnections have not been produced which include no dead air space so that it was impossible, using prior art devices, to exclude all air from the system upon interconnection.

SUMMARY OF THE INVENTION

The present invention provides a valve for interconnecting two conduit sections in a vacuum system. The preferred embodiments incorporate this valve to connect a vaporizable liquid and a vapor-absoptive chemical without introducing residual air during or after interconnection. This is accomplished in a first embodiment in which two conduit sections are physically separable by providing stoppers at the exposed end of each of the conduit sections and providing an apparatus whereby the stopper on one conduit section may be pushed against the stopper on the other conduit section to slide each of the stoppers into a receptacle formed to remove the stoppers from their associated conduit sections. The direct abuttment of the pair of stoppers during this operation assures that no air will be entrained in the valving system during interconnection. A sealing interior diameter on one of the conduits which receives the exterior diameter of the remaining conduit section assures adequate sealing of the conduit sections to one another during and after engagement.

In a second embodiment the conduit sections move relative one another, with a resilient bushing used to seal the moving interface. This same bushing is used to close and open a valving orifice which fluidly interconnects the conduit sections.

The present invention may be particularly advantageous for a single utilization of the vacuum system. In particular, in such an application, the vaporizable liquid and vapor-absorptive chemical are supplied in evacuated, disposable containers, each having a conduit section for interconnection. Once interconnected, the heating and cooling process continues until the chemical reaction is complete, that is, the vapor-absorptive chemical has become sufficiently saturated with vapor that it cannot further reduce the vapor pressure of the vaporizable liquid sufficiently to reduce the boiling point of the liquid below the temperature at which the liquid is stored. The containers, along with the interconnect, are then disposed of and a new vaporizable liquid and vapor-absorptive chemical container are supplied if further or later cooling or heating is required. Because the device in this case is intended to be disposed of after use, it is important that the vacuum valve and interconnect of the present invention, in addition to fulfilling the requirements listed above, be extremely inexpensive to manufacture. This is accomplished both through the simplicity of the design of the present invention and a proper use of materials in the invention. Even if the cooling system is designed to be recharged, as by heating the vapor-absorptive chemical container to increase the upper pressure of the enclosed material while cooling the vaporizable liquid container, it is advantageous to lower the cost of the interconnect as much as possible. Thus, the valve and interconnect of this invention has broad application in the chemical cooling and heating art.

These and other advantages of the present invention are best understood through the following detailed description of the preferred embodiments which reference the drawings in which:

FIG. 1 is a sectional view of a cooling chest utilizing the vacuum interconnect of a first embodiment of the present invention after the conduit sections have been joined, the interconnect being shown in elevation;

FIG. 2 is a sectional view of a first conduit section connected to the vaporizable liquid container within the cooling chest of FIG. 1 prior to interconnection of the interconnect of the present invention;

FIG. 3 is a sectional view of the other conduit section connected to the vapor-absorptive chemical container of FIG. 1 prior to interconnection of the interconnect device of the present invention;

FIG. 4 is a sectional view of the interconnect device of FIG. 1 at a stage during connection of the conduit sections;

FIG. 5 is a sectional view similar to FIG. 4 showing the location of the elements of the interconnect device after interconnection is complete;

FIG. 6 is an exploded respective view partially cut away of a second embodiment of the present invention and portions of the cooling chest to which it fits;

FIG. 7 is a sectional view of the refrigeration system of FIG. 6 prior to initiation of the refrigeration cycle;

FIG. 8 is a sectional view similar to that of FIG. 7 showing the refrigeration system of the present invention after initiation of the refrigeration cycle;

FIG. 9 is a sectional view similar to that of FIGS. 7 and 8 showing a second alternate embodiment of the vacuum interconnect valve of the present invention;

FIG. 10 is a partial sectional view showing a valve similar to that of FIG. 1 used with containers similar to those of FIG. 7; and FIG. 11 is a partial perspective view of an alternate form of cooler chest for use with the embodiment of FIG. 7.

DETAILED DESCRIPTION OF THE PREFERRED EMBODIMENT

Referring initially to FIG. 1, the present invention is incorporated within a cooling chest 11 which may be fabricated, for example, of styrofoam or other lightweight insulating material in a standard fashion. The chest 11 includes a lid 13, preferably also formed of insulating material, and thus forms a cavity 15 for the storage of materials to be refrigerated. Unlike standard styrofoam chests of this type, the chest 11 may include an extension 17 of the bottom wall for supporting and protecting a portion of the cooling apparatus.

The detailed description of the chemical processes and apparatus used for refrigeration purposes may be found in my prior U.S. Pat. No. 3,642,059, issued Feb. 15, 1972, the description of which is hereby incorporated in this specification by reference. For the purpose of understanding the apparatus of the present invention, it is sufficient to understand that a container 19 includes a vaporizable liquid such as water. In the first embodiment, the container 19 is advantageously laid flat on the bottom of the chest 11 and is hermetically sealed. A second container 21 includes a vapor-absorptive chemical, for example, magnesium chloride, suitable for absorbing the vapors produced when liquid within the container 19 evaporates. In the first embodiment, the container 21 may advantageously be supported by the extending ledge 17 of the styrofoam container 11 or in other locations relatively close to the chest 11.

The details of construction of the first embodiment of this invention will now be described in reference to FIGS. 1–5. A connector 23 which forms the primary element of the present invention is used for interconnecting the containers 19 and 21. Prior to refrigeration of the chest 11, the container 21 may be stored with the container 11 to protect it from abuse and to facilitate transportation of the chest 11, or this container 21 may be stored elsewhere, particularly if the chest 11 is full of items to be cooled.

The primary function of the connector 23 is to permit the cooling chest 11 to be repeatedly refrigerated with disposable containers 19 and 21, the containers 19 and 21 being disposed of after each refrigeration cycle. Since it has been found that the containers 19 and 21 with their enclosed contents can be made quite cheaply, it is advantageous to produce these in disposable form. From my prior patent it will be understood that evaporation of the liquid in container 19 and the absorption of the vapors produced thereby in the container 21 will cool the container 19 and heat the container 21. Heat from the container 21 is dissipated to the surrounding atmosphere while the cooling of the container 19 is used to refrigerate the chest 11. It will be understood, of course, that using the interconnect of the present invention, the container 19 may be placed outside of the chest 11 and the container 21 placed inside of the chest 11 so that heat is absorbed from the surroundings by the cooled container 19 and the heated container 21 may be used for heating the interior of the chest 11 and its contents.

It will also be understood from my prior patent that it is important for efficient operation of this refrigeration and heating system that the containers 19 and 21 be evacuated during storage prior to use as well as during actual refrigeration and heating. The container 19 is evacuated prior to use to expel all air from the container 19 so that the pressure within the container 19 prior to use is determined by the vapor pressure of the vaporizable liquid. The container 21 is evacuated to remove as much air as possible from the container prior to use. The operation of this system requires that vapor absorbed in the container 21 be sufficient to reduce the vapor pressure above the liquid in the container 19 so that the liquid will boil at a relatively low temperature and, in the boiling process, remove the heat of vaporization from the chest 11. Any air trapped within the system will interfere with the vapor process.

Referring now to FIG. 2, the interconnect section attached to the container 19 will be described. The container 19 includes the vaporizable liquid 24 and a void 25 which communicates with a short tube 27 sealed to one end of the container 19. The container 19 and tube 27 are advantageously formed of metal and must be designed to maintain a vacuum within the container 19 above the liquid 24 without collapsing. The tube 27 is attached, as by solder, to a metal tube 29, the inside diameter of which conforms the the outside diameter of the tube 27. The tube 29 is, in turn, sealed and attached to a second metal tube 31 which is supported on and sealed to an interconnect housing 33. The housing 33 is used to support a sealing tube 35 formed of resilient material such as rubber. The tube 35 includes a generally cylindrical bore 37 terminating at one end in a frusto-conical interior diameter portion 39.

The housing 33 is formed as a main metal tube body 41, the interior diameter of which is approximately equal to the exterior diameter of the sealing tube 35, and the ends of which are crimped at 43 and 45 to maintain the longitudinal position of the sealing tube 35. A metal washer 47 is advantageously positioned between the crimped end 43 of the tube 41 and one end of the sealing tube 35. The washer 47 has an inside diameter which is larger than the largest diameter of the frusto-conical interior diameter portion 39 of the tube 35 and is used as a bearing surface, as will be understood from the description which follows. The other end of the sealing tube 35 which is positioned by the crimped end 45 of the tube 41, opens into a cup-shaped closure member 49, the inside diameter of which conforms with the outside diameter of the tube 41. The closure 49 is soldered to the metal tube 41, and includes an aperture, as does the tube 41, for receipt and mounting of the tube 31. The sealing tube 35 includes a lateral aperture 51 communicating with the tube 31 as well as the central bore 37.

The cup-shaped closure 49 advantageously terminates in an annularly extending flange 53 which serves as a stop when the interconnect housing 33 is placed in the styrofoam chest 11. The styrofoam chest 11 includes a bore 55 extending through one side wall which is sized to receive the tube 41.

It will be understood that the container 19 is supplied with the interconnect housing 33 attached. A frusto-conical stopper 57, formed, for example, of rubber, closes the frusto-conical inside diameter portion 39 of the sealing tube 35. The entire system is evacuated at the factory and shipped as an evacuated, hermetically sealed unit. Vacuum within the system maintains the stopper 57 in a closed position, bearing against the frusto-conical interior wall 39. On replacement, the new interconnect housing 33 may be slid into the aperture 55 in the chest 11 until the flange 53 abutts the interior wall of the chest 11.

Referring now to FIG. 3, the second interconnect section will be described. This section is attached to the vapor-absorptive chemical container 21 which is generally formed as a flat metal container including a partition 59 separating a vapor-absorptive chemical 61 from a void 63. The vapor-absorptive chemical 61 is advantageously placed along the exterior wall of the container 21 for direct dissipation of heat to the atmosphere. The chemical 61 and vapor-porous partition 59 may be maintained in this position by a plurality of longitudinally extending partitions 65 which are apertured to permit vapor flow throughout the entire void 63.

The metal container 21 includes a tubular extension 67 advantageously formed of metal and threaded on its outside diameter. A threaded sleeve 69 formed, for example, of plastic, is threaded onto the outside diameter of the tube 67. The tube 67, in turn, supports an elongate metal tube 71 sealed to the tube 67 and in fluid communication with the void 63. The end of the tube 71 opposite the container 21 is sealed by a stopper 73 formed of rubber or other similar resilient material and having a cylindrical portion 75 of a relaxed diameter larger than the interior diameter of the tube 71 so that it will tightly seal against the tube 71. The end of the stopper 73 is formed as a frusto-conical end 77, the large diameter of which is greater than the outside diameter of the tube 71 and the small diameter of which is approximately equal to the large diameter of the rubber stopper 57 (FIG. 2). The interior void 63 of the container 21 is evacuated at the factory and the stopper 73 is positioned in the tube 71 so that the apparatus is shipped hermetically sealed and evacuated. The vacuum helps to hold the stopper 73 in place in the end of the tube 71 during shipment.

In using the interconnect assembly 23, the sections of which are shown in FIGS. 2 and 3, the tube 71 with its attached stopper 73 is positioned against the stopper 57, and the tube 71 is forced into the cylindrical bore 37, forcing ahead of it the stopper 73 and the stopper 57. It will be seen that, as the frusto-conical end 77 of the stopper 73 is abutted against the end of the stopper 57, no air will be entrained between these members. Furthermore, as the frusto-conical outside diameter of the stopper 77 enters the cylindrical bore 37, no air will be entrained between the tube 71 and the bore 37. Specifically, the resilient sealing tube 35 will squeeze the frusto-conical end 77 of the stopper 73 so that its outer surface conforms generally to a cylinder having a diameter approximately equal to the outside diameter of the tube 71. The tube 71 will be sealingly engaged with the sealing tube 35, since it has an outside diameter which is larger than the relaxed bore 37, and the sealing tube 35 must thus resiliently expand to receive the tube 71.

The tube 71 is pushed completely into the sealing tube 35 until the threaded sleeve 69 abutts the washer 47, as shown in FIG. 4. At this point the stopper 57, now released from the sealing tube 35, will fall into the cup-shaped closure 49. The threaded sleeve 69, which advantageously has a knurled outside diameter, may now be rotated to thread this member on the threaded tube 67 and thereby draw the tube 71 partially out of the sealing tube 35. This operation continues with the threaded tube 69 bearing on the washer 47 until the tube 71 has been drawn beyond the aperture 51. During this operation the frusto-conical head 77 of the stopper 73 will engage the end 79 of the sealing tube 35. Since a vacuum now exists on both sides of the stopper 73, the stopper 73 is easily drawn out of the tube 71. The outside diameter of the cylindrical portion 75 of the stopper 73 is advantageously smaller than the inside bore 37 of the sealing tube 35, so that the stopper 73 will fall into the cup-shaped closure 49. If it does not fall into the cup-shaped closure 40, it will reside in the end of the bore 37 and will not interfere with the operation of the system.

The system, as shown in FIG. 5, now interconnects the containers 19 and 21, and refrigeration and heating will occur. It can be seen that no air has been entrained in the system during interconnection, since the outside diameter of the tube 71 is sealed at all times during interconnection to the sealing tube 35, and the interface of the stoppers 57 and 73 is formed so that no air is entrained between these members or between either of these members and the bore 37.

The present invention thus produces an extremely simple and inexpensive interconnect assembly which may be made as a disposable unit. This assembly permits hermetic sealing of the containers 19 and 21 during storage and shipment and permits an interconnection of these members without degrading the vacuum within the system.

Referring now to FIG. 6, an alternate embodiment of this invention will be described. In this embodiment the liquid container 81 and vapor-absorptive channel container 83 are not disconnected at manufacture but rather are shipped as a combined unit with an interface valving system 85. Specifically, the liquid container 81 is advantageously formed as a simple, metal can such as that used in the marketing of canned fruits and vegetables. It has been found that such a can is capable of supporting the vacuum required for the present type of refrigeration and heating system. The container 83 for the vapor-absorptive chemical is formed as a similar can which may or may not be of a different shape. In the embodiment shown, it is greater in diameter but shorter in height for convenience during use. In this embodiment the lid 13 of a cooler chest, such as that shown in FIG. 1, includes a circular through-bore 87 of substantially the same diameter as the can 81. Surrounding this bore 87 is a cylindrical recess 89 having a diameter approximately equal to the diameter of the can 83 but passing only part way through the lid 13. In one upper corner of the cooler chest 11 a cylindrical recess 91, having a height approximately equal to the height of the can 81, is formed. This cylindrical recess, as shown, is positioned so that it is open on one side to the interior 15 (FIG. 1) of the cooler chest so that when the can 81 is cooled, it can cool the contents of the chest 11.

As shown in FIG. 6, prior to installation into the cooler chest 11, the cans 81 and 83 are separated a short distance, and this separation is maintained by a cylindrical, styrofoam spacer 93 having a slot 95 which permits its placement around the valve member 85 and its removal from this location. A strip of tape 97 is used to hold the spacer 93 in position around the valve 85 prior to use of the refrigeration and heating assembly.

Referring now to FIG. 7, the construction of the refrigeration and cooling device and the location of its component parts prior to initiation of a refrigeration cycle will be described. The can 81 is partially filled with a liquid to be vaporized, such as water 99. Above the water 99 is a void 101 which is evacuated at the factory. The upper end of the can 81 includes an aperture which sealingly receives the valve member 85 which is formed as a hollow tube open into the void 101 but sealed at its upper end 103. The tube 85 includes an orifice 105 close to its upper end and passing through the side wall of the tube 85.

The lower flat end of the can 83 includes an aperture which is sealingly attached to a depending rubber sleeve 107. The sleeve 107 has a relaxed inner diameter which is smaller than the outer diameter of the tube 85 so that, when assembled as shown in FIG. 7, the sleeve 107 tightly surrounds the end of the tube 85 closing the aperture 105. A styrofoam spacer 109 surrounds the sleeve 107 and abutts the spacer 93 prior to initiation of the refrigeration cycle.

When the refrigeration cycle is to begin, the user removes the styrofoam spacer 93 after stripping away the tape 97 leaving an open space between the styrofoam spacer 109 and the upper flat end of the can 81. The can 81 is then slid through the bore 87 in the lid 13 of the cooler chest and into the cylindrical cavity 91 of the cooler chest 11 until the bottom flat end of the can 81 abutts the bottom 111 of the cylindrical recess 91. Continued downward pressure on the upper can 83 will slide the tube 85 within the tight rubber sleeve 107 until the aperture 105 enters the interior of the can 83 to permit fluid communication between the can 81 and the can 83 through the tube 85 and the orifice 105.

As shown in FIGS. 7 and 8, the can 83 conveniently contains vapor-absorptive chemical 113 in an annular cavity adjacent its cylindrical wall, with a vapor-porous baffle 115 used to support the chemical 113 in physical contact with this outer wall. The interior of the can 83 thus forms a void 117 which is evacuated at the factory.

The vacuum within the voids 101 and 117 is maintained by the hermetic seal between the orifice 105 and rubber sleeve 107 after manufacture and prior to initiation of the refrigeration cycle. When the valve is operated by pushing the upper can 83 to the position shown in FIG. 8, the orifice 105 opens to the void 117 to permit the refrigeration cycle to commence without permitting the introduction of any air into the system. The rate of cooling may also be controlled by pushing the upper can 83 only part of the way to the position of FIG. 8, thus opening only a portion of orifice 105. It can thus be seen that an extremely inexpensive and simple valving arrangement has been provided by this embodiment which permits a disposable refrigeration system. It should, of course, be understood that by placing the vapor-absorptive chemical 113 in the lower can 81 and the fluid to be vaporized in the upper can 83, a similar assembly can be used for heating the contents of the chest 11. This arrangement will require a standpipe so that the tube 85 extends above the water level in can 81 when the can 81 is inverted. In this regard, it is also possible to make each of the cans 81 and 83 of a shape and size equivalent to the can 81 of this embodiment, and to lengthen the pipe 85 to form a standpipe, while filling container 81 less than one-half full of liquid, so that this one unit may be used for either heating or cooling the contents of the chest 11 by simply inverting the unit before its placement in the chest 11.

Referring now to FIG. 9, a second alternate embodiment of the present invention will be described. This embodiment is identical, in most respects, to the embodiment of FIG. 6 through 8 except that the styrofoam spacer 93 is not used and the cans 81 and 83 are placed closer to one another by a distance equivalent to the height of the spacer 93. In addition, the aperture 105 in the tube 85 is replaced by a teardrop-shaped aperture 119. Finally, an aperture 121, through one wall of the rubber sleeve 107, is provided. In the embodiment of FIG. 9, rather than a telescoping displacement of the members to initiate the refrigeration cycle, the cans 81 and 83 are rotated relative one another. During such rotation, the aperture 119 in the tube 83 aligns with the aperture 121 in the sleeve 107 to permit fluid communication between the voids 101 and 117 in the cans 81 and 83, respectively. The teardrop shape of the aperture 119 permits an adjustment in the rate of heating and cooling of this device, although this can be accomplished using a circular aperture as well. Thus, if the can 83 is rotated relative the can 81 to a position where only the pointed leading edge of the aperture 119 overlaps the circular end of the orifice 121, only a small, metered flow of water vapor can pass from the void 101 to the void 117. As the can 83 is rotated further relative the can 81, the larger circular end of the teardrop opening 119 will open to completely open the end of the aperture 121 to the tube 83 to permit a maximum flow of vapor between the vessels. It is possible, therefore, in this embodiment, to place marks on the exterior of the cans 81 and 83 which may be used by the user to adjust the rate of opening of the orifice 121 and to thereby adjust the rate of heating and cooling of the system.

Referring now to FIG. 10, an alternate embodiment similar to that of FIG. 1, will be described. In this case the valve 23 is identical to that shown in FIG. 1 except that it passes through an aperture in the wall of the chest 11 which is closer to the lid 13 so that it can communicate between the tops of a pair of metal cans 131 and 133 which are quite similar to the cans 81 and 83 of FIG. 7. The can 131 stores vaporizable liquid 135 while the can 133 stores vapor-absorptive chemical 137 surrounding a vapor permeable partition 139. This construction permits the use of inexpensive metal cans, such as those of FIGS. 6 through 9, in conjunction with the valve of FIGS. 1 through 5, which permits the cans 131 and 133 to be separated prior to use.

Referring to FIG. 11, an alternate method of using the cooling system of FIGS. 6–9 is shown. In this case, the lid 13 of the chest 11, rather than being bored, includes a slot 141 communicating with one edge. The containers 81 and 83 are then pushed together for the embodiment of FIGS. 6 through 8 or rotated for the embodiment of FIG. 9 to initiate cooling and the interconnecting tube 85 is placed in the slot 141. The lid 13 may then be placed on the cooling chest 11. Alternatively, of course, the containers 81 and 83 may first be placed on alternate sides of the lid 13 by positioning the tube 85 in the slot 141 and then pushed together or relatively rotated to initiate cooling. In this manner the lid 13 will support the cans 81 and 83 while providing an extremely inexpensive modification to standard cooling chests.

What is claimed is:

1. An absorptive refrigeration system, comprising:

a first evacuated vessel containing a fluid to be vaporized;

a second evacuated vessel containing a vapor absorptive chemical;

a conduit interconnecting said first and second vessel; and means for selectively opening said conduit without degrading the vacuum therein, said means comprising:

a hollow tubular member in fluid communication with one of said first and second vessels; and a resilient sleeve fitting tightly against said hollow tubular member, separating said hollow tubular member from the other of said first and second vessels, and moveable relative said hollow tubular member for opening and closing a passage between said first and second vessels.

2. An absorptive refrigeration system as defined in claim 1 wherein said resilient sleeve is axially moveable relative said hollow tubular member for opening and closing said passage.

3. An absorptive refrigeration system as defined in claim 1 wherein said resilient sleeve is rotationally moveable relative said hollow tubular member for opening and closing said passage.

4. An absorptive refrigeration system as defined in claim 1 wherein said conduit comprises two separate conduit sections, said conduit sections separate one from the other, but interconnectible and wherein said hollow tubular member is mounted on one of said conduit sections and said resilient sleeve is mounted on the other of said conduit sections.

5. An absorptive refrigeration system as defined in claim 4 additionally comprising:

a pair of stoppers, one of which is mounted to close said hollow tubular member and the other of which is mounted to close said resilient sleeve.

6. An absorptive refrigeration system as defined in claim 5 wherein said means for selectively opening said conduit additionally comprises:

means for removing said pair of stoppers from said hollow tubular member and said resilient sleeve after movement of said resilient sleeve relative said hollow tubular member.

7. An absorptive refrigeration system, comprising:

a first evacuated vessel containing a fluid to be vaporized;

a second evacuated vessel containing a chemical for absorbing vapor from said fluid;

a tube, one end of which is in fluid communication with one of said first and second vessels;

a resilient tubular sleeve, the relaxed inside diameter of which is smaller than the outside diameter of said tube, one end of said sleeve connected for fluid communication with the other of said first and second vessels; and means for sealing the other ends of said tube and said sleeve prior to insertion of said tube into said sleeve, said means opening the other ends of said tube and said sleeve on insertion of said tube into said sleeve.

8. An absorptive refrigeration system as defined in claim 7 wherein said sealing means comprises a pair of stoppers, one mounted in the other end of each of said tube and said sleeve, and wherein one end of said sleeve is formed to remove said pair of stoppers from the other end of said tube and said sleeve on insertion of said tube into said sleeve.

9. An absorptive refrigeration system as defined in claim 7 additionally comprising:

a threaded sleeve threaded onto said tube, said sleeve limiting the insertion of said tube into said sleeve and threadable to partially remove said tube from said sleeve after insertion of said tube into said sleeve.

10. An absorptive refrigeration system as defined in claim 7 additionally comprising:

an insulated container housing one of said first and second evacuated vessels, said container including an aperture for receipt of said tube.

11. An evaporative refrigeration system, comprising:

a first evacuated container storing a liquid to be evaporated;

a second evacuated container storing a chemical for absorbing the vapors of said liquid;

a first conduit section mounted on and in fluid communication with said first container, said first conduit section sealed to maintain the vacuum of said first container;

a second conduit section completely separate and removable from said first conduit section, said second conduit section mounted on and in fluid communication with said second container and sealed to maintain the vacuum of said second container; and means for coupling said first and second conduit sections together for fluid communication therebetween and between said first and second containers without the introduction of any air to said conduit sections or said containers.

12. An evaporative refrigeration system as defined in claim 11 wherein said means for coupling said first and second conduit sections together comprises a resilient sleeve mounted on one of said conduit sections for resiliently and sealingly receiving the other of said conduit sections to provide a flow path through said conduit sections.

13. An evaporative refrigeration system as defined in claim 12 wherein said means for coupling additionally comprises:

a resilient stopper mounted in said resilient sleeve for sealing said sleeve, said resilient stopper removed from said resilient sleeve upon insertion of said other of said conduits.

14. An evaporative refrigeration system, comprising:

an insulated vessel for storing items to be refrigerated or heated, said vessel including an aperture through one of its walls;

a first evacuated container storing a liquid to be evaporated;

a second evacuated container storing a chemical for absorbing the vapors of said liquid, one of said first and second evacuated containers being mounted within said insulated vessel;

a conduit section interconnecting said first and second evacuated containers and passing through said aperture in said vessel wall; and a resilient sleeve forming a portion of said conduit, said sleeve resiliently biased against a portion of said conduit for sealing said conduit and mounted to move relative said portion of said conduit for opening and closing said conduit to provide fluid communication between said first and second evacuated containers.

15. An evaporative refrigeration system as definded in claim 14 wherein each of said first and second evacuated containers are constructed of lightweight sheet metal material and are disposable after completion of a single refrigeration cycle.

* * * * *